US005132503A

United States Patent [19]

Lee

[11] Patent Number: 5,132,503

[45] Date of Patent: Jul. 21, 1992

[54] APPARATUS FOR DETECTING THE OPEN OR CLOSED CONDITION OF A MICROWAVE OVEN DOOR

[75] Inventor: Joon K. Lee, Seoul, Rep. of Korea

[73] Assignee: Samsung Electronics Co., Ltd., Kyungki, Rep. of Korea

[21] Appl. No.: 635,695

[22] Filed: Dec. 28, 1990

[30] Foreign Application Priority Data

Dec. 30, 1989 [KR] Rep. of Korea ..... 89-20810

[51] Int. Cl.[5] ..... H05B 6/68

[52] U.S. Cl. ..... 219/10.55 C; 219/10.55 B; 219/10.55 D

[58] Field of Search ..... 219/10.55 C, 10.55 D, 219/10.55 B; 126/197

[56] References Cited

U.S. PATENT DOCUMENTS 4,638,137 1/1987 Kazumi ..... 219/10.55 B
4,760,229 7/1988 Steers et al. ..... 219/10.55 D
4,982,063 1/1989 Tsunekawa et al. ..... 219/10.55 C

FOREIGN PATENT DOCUMENTS 3236290 4/1984 Fed. Rep. of Germany ... 219/10.55 C
62-153633 7/1987 Japan ..... 219/10.55 C

*Primary Examiner*—Philip H. Leung
*Attorney, Agent, or Firm*—Burns, Doane, Swecker & Mathis

[57] ABSTRACT

A door condition sensing apparatus for a microwave oven includes a mechanical switch and a photodetector, each of which is separately responsive to the closing of the door. A microprocessor receives signals from both the switch and the photo-detector to determine whether the door is closed. The photo-detector is actuated by a lever which is swung by the door as it closes. The lever comprises an actuator arm of a second switch connected to the microprocessor.

4 Claims, 2 Drawing Sheets

APPARATUS FOR DETECTING THE OPEN OR CLOSED CONDITION OF A MICROWAVE OVEN DOOR

BACKGROUND OF THE INVENTION

The invention relates to an apparatus for detecting whether microwave oven's door is open and closed, particularly to an apparatus compensating for a defective mechanical switch by using a photo-detecting sensor.

When the human body is exposed to microwaves generated by a microwave oven, the human body is seriously hurt. For example, fi a human eye is exposed to microwave, it can cause cataracts.

In order to minimize said danger generated by exposing a human body to microwaves, the conventional microwave oven uses a mechanical switch so that the range operates only when its door is completely closed so that microwaves do not leak.

However, because of mechanical abrasion due to extended use over a long period of time, the mechanical switch may possibly malfunction. Therefore, the microwave oven may operate with its door not completely closed, so that it is possible that microwaves leak out. In order to compensate for a defective mechanical switch, the opening and closing of the microwave oven's door is detected by a microprocessor; the self-contained microprocessor controls operation of the microwave oven according to a detected state, thereby leakage of microwave is protected.

As a typical example, U.S. Pat. No. 4,638,137 disclosed such an apparatus. In that apparatus, cooking time is input through a keyboard, and, if the microwave oven's door is closed, a door key pushes one part of a slide plate. A stop plate which is an integral part of a cooking start button prevents the slide plate from moving. However, if the cooking start button is pushed, the stop plate moves forward, so that the slide plate moves in the door key pushing direction and a heat start switch is closed. At this time, a first switch which connects first windings of a transformer to a power line is closed, and a second switch moving together with the first switch is closed, so that a signal informing that the heat start switch is closed is sent to a microprocessor. The microprocessor receives said signal and energizes relay windings via a converter, so as relay switch is closed and the first windings of the transformer are connected with the power lien. Also, power is applied to the first windings through a switch which moves together, with the door that is to say, when the door is closed, the switch is closed and, when the door is open, the switch is open, whereupon a magnetron operates and microwaves are generated.

Although a microprocessor is aware of the opening and closing of the door through the mechanical switch which detects the state of door and sends a signal corresponding to state of the door to the microprocessor, when the mechanical switch malfunctions, it is possible for the microprocessor to misunderstand the state of the door.

SUMMARY OF THE INVENTION

Accordingly, the invention is created in order to solve the problem, the object of the invention being to supply an apparatus which detects the state of the door by using a photo-detecting sensor as well as a mechanical switch. Another object of the invention is to supply an apparatus which controls microwave oven according to state of door by using a mounted microprocessor.

DETAILED DESCRIPTION OF THE INVENTION

Figure 1:
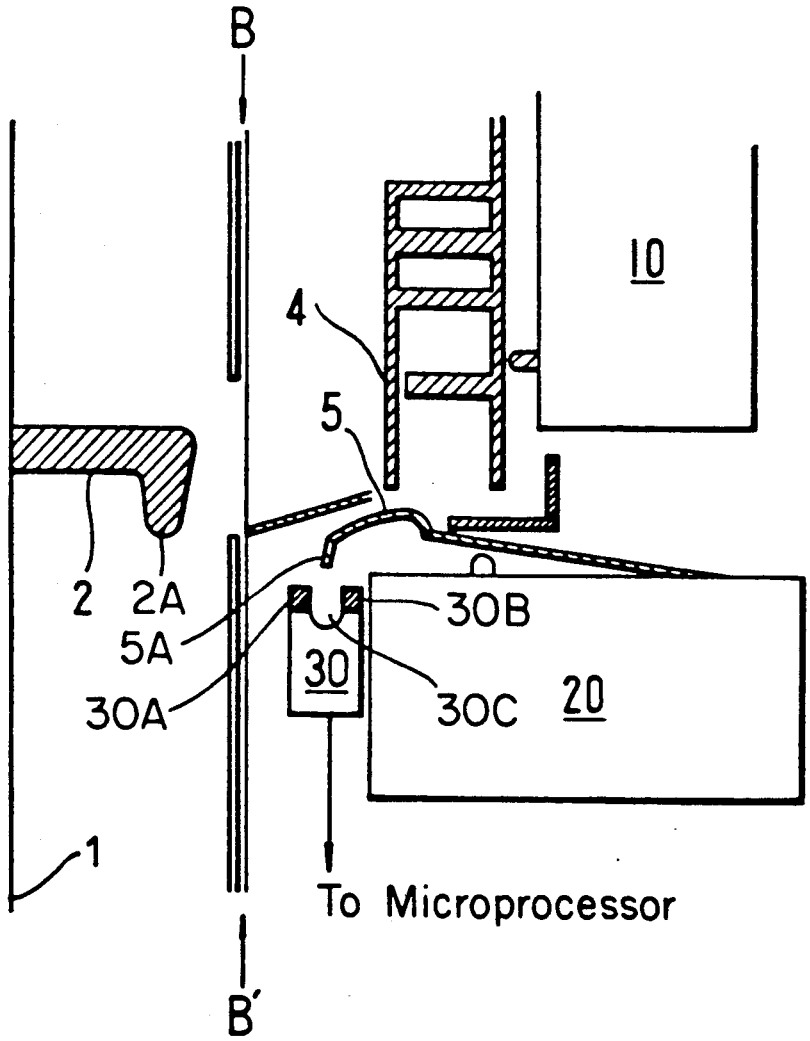
FIG. 1 is a schematic fragmentary side elevational view of a microwave oven'door opening and closing detecting apparatus in which photo-detecting sensor is mounted, according to the invention.

Referring to the drawings, the invention is described in detail. FIG. 1 shows a principle part of an apparatus according to the invention. A door 1 is hinged to the main body of a microwave oven. A door hook 2 is attached to the door 1. The door hook 2 goes inside of a latch apparatus B-B' through an opening drilled in the latch apparatus 8-8'. An elastic end of an operating plate 4 is fixed to the latch apparatus B-B' and the other end of the operating plate not fixed to the latch apparatus B-B' is forced to move by the door hook 2, so that a first microswitch 10 is turned on. Because the first microswitch 10 connects power to the first windings of a transformer, when the door hook 2 pushes the operating plate the transformer is connected to power.

Also, a bent end 2A of the door hook 2 pushes downward a lever 5 when the door hook 2 enters the latch apparatus. When the lever is pushed downward, a second microswitch 20 connected to the microprocessor is turned on.

A photo-detecting sensor 30 is mounted in front of the second microswitch 20, and the photo-detecting sensor 30 comprises a light emitting element 30A and a light receiving element 30B forming a detecting zone 30C therebetween. When the lever 5 is pushed downward, end 5A of the lever 5 is inserted into the photo-detecting sensor 30. The photo-detecting sensor 30 s electrically connected to the microprocessor. When the lever 5 is inserted into the photo-detecting sensor 30, it sends an "off signal" to the microprocessor, and, when the lever 5 is not inserted into the photo-detecting sensor 30, it sends an "on signal" to the microprocessor.

Figure 2:
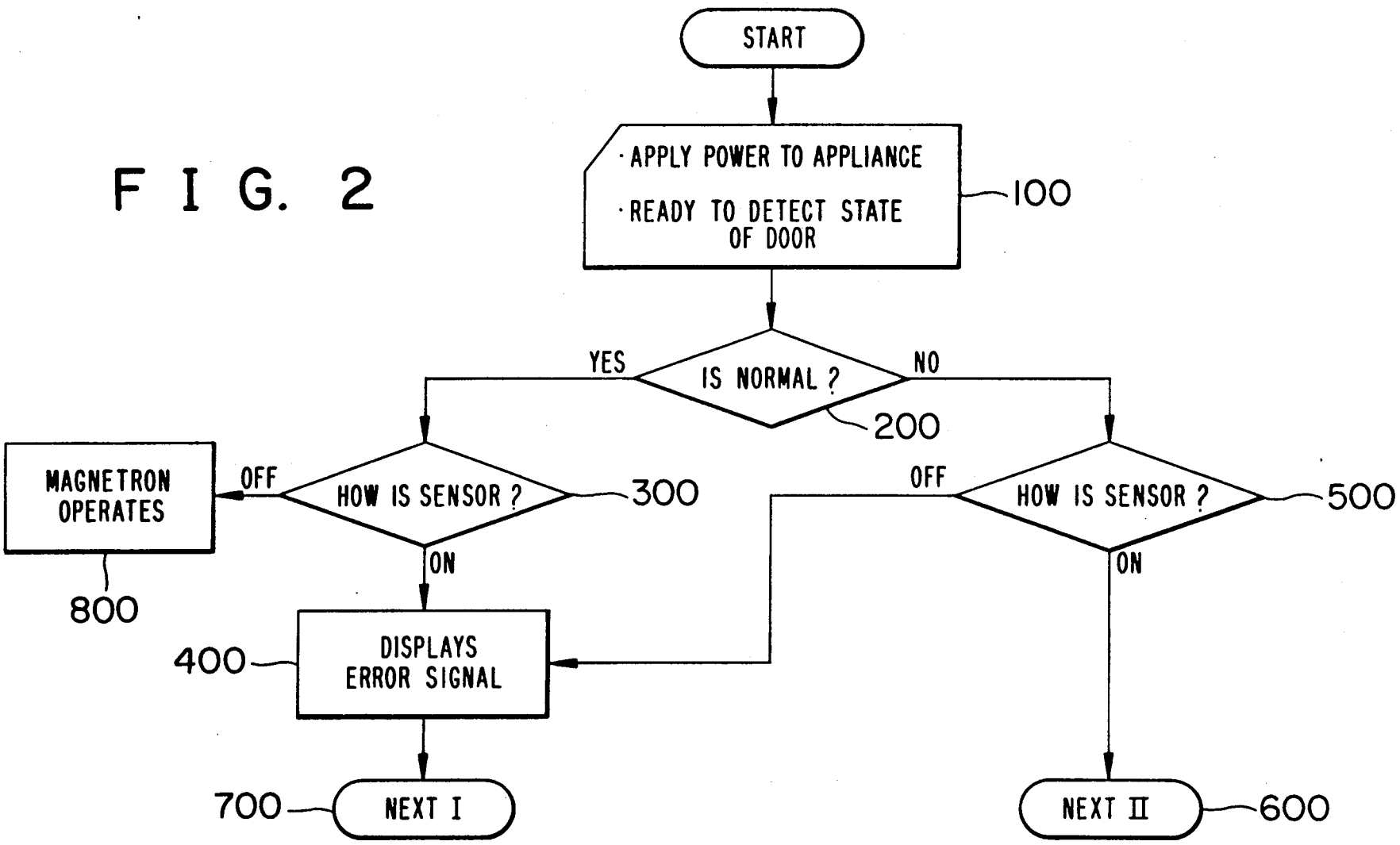
FIG. 2 is a flow chart showing the method of the invention which controls the operation of a microwave oven according to the state of the door by using the photo-detecting sensor.

FIG. 2 is a flow chart showing operation of the microprocessor according to the invention.

When the power is applied to the microwave oven according to the invention, the microprocessor is ready to detect the state of the door (processing block 100). When the door hook 2 is inserted into inside of the latch apparatus B-B', the end of the door hook 2 not only pushes the operating plate 4 in the direction of advancing the door hook 2 but also pushes downward the lever 5. At this time the second microswitch 20 is turned on with the lever 5 pushed downward. The first microswitch 10 is interposed between the first windings of the transformer and the power line. When the operating plate 4 is pushed by the closing door, the first microswitch 10 is turned on and connects the first windings of the transformer to the power line. The second microswitch 20 is connected to the microprocessor. When the second microswitch 20 is turned on by the door hook 2, an "on" signal is send to the microprocessor, so that the microprocessor decides that the door is in a normal closed state (processing block 200). Then, the microprocessor inquires whether or not the photo-detecting sensor 30 is turned on and decides the state of the photo-detecting sensor 30 at processing block 300. That is to say, when the lever 5 is insert into the photo-detecting sensor 30, it sends an "off" signal to the microprocessor, and, when the lever 5 is not inserted into the photo-detecting sensor 30, it sends an "on" signal to the microprocessor. Therefore, the microprocessor decides one more time the state of the door 1. When the photo-detecting sensor 30 is turned off, the magnetron is driven during time set through keyboard (not shown), so that the microwave range cooks food in its cooking chamber (processing block 800). When the photo-detecting sensor 30 is turned on, the microprocessor displays error in a display board (processing block 00), and it operates next (processing block 700). Here, the position of the photo-detecting sensor 30 which is turned on and off by the lever 5 can be adjusted up and down in the range to detect that an alien substance is interposed between the door 1 and the opening of the cooking chamber. When the door 1 is abnormally closed, that is to say, when the second microswitch 20 is turned off, the microprocessor inquires whether or not the photo-detecting sensor 30 is turned on and decides the state of it at processing block 500. In case that the photo-detecting sensor 30 is turned off, the microprocessor displays error in he display board at processing block 400 and operates next (processing block 700). In case the photo-detecting sensor 30 is turned on, the microprocessor performs next operation (for example, stand by) at processing block 600.

In another embodiment of the invention, an apparatus according to the invention comprises a photo-detecting sensor without a mechanical switch. In this case, the lever 5 is merely a lever mounted in a latch apparatus instead of level of being the microswitch. We have the advantage that the number of a elements is reduced and a work process is simple.

As described above, the invention decides the state of door by using the mechanical witch and the photo-detecting sensor in order to prevent leakage of microwave from the microwave oven, and it compensates for a defective mechanical switch, displays the state of door and alarms according to the state of door.

What is claimed is:

1. A door condition detecting apparatus in a microwave oven having an openable and closable door, said door including a hook, said apparatus comprising a switch and a photo-detector each being responsive to the closing of the door, and a microprocessor operably connected to said switch and said photo-detector and being responsive to signals form said switch and said photo-detector for determining whether said door is in a closed condition, said switch including an actuating lever which is displaced by said door hook to an actuating position causing said switch to signal said microprocessor that said door is closed, a portion of said lever being arranged to actuate said photo-detector to signal said microprocessor that said door is closed when said lever is displaced to said actuating position.

2. Apparatus according to claim 1, wherein said photo-detector includes detecting zone, said portion of said lever being arranged to enter said detecting zone to actuate said photo-detector.

3. Apparatus according to claim 2, wherein said lever is mounted at one end such that an opposite free end of said lever is swingable to and from said actuating position, said opposite end being bent to define said portion of said lever which actuates said photo-detector.

4. Apparatus according to claim 3, wherein said photo-detector includes light emitting and light receiving elements forming said detecting zone therebetween.

* * * * *